United States Patent [19]

Wolski

[11] 4,186,980

[45] Feb. 5, 1980

[54] METHOD AND APPARATUS FOR CONSTRUCTING ELECTRONIC DEVICES

[75] Inventor: Adolph Wolski, Morton Grove, Ill.

[73] Assignee: Ni-Tec, Inc., Niles, Ill.

[21] Appl. No.: 518,479

[22] Filed: Jan. 3, 1966

[51] Int. Cl.[2] ..... H01J 9/18
[52] U.S. Cl. ..... 316/19; 316/31
[58] Field of Search ..... 316/17, 18, 19

[56] References Cited

U.S. PATENT DOCUMENTS

| | | | |
|---|---|---|---|
| 2,154,368 | 4/1939 | Tuuk et al. | 316/19 |
| 3,095,251 | 6/1963 | Slark | 316/19 |

*Primary Examiner*—Verlin R. Pendegrass

EXEMPLARY CLAIM

1. A method of constructing an electronic device comprising the following steps:

processing at least a portion of a first component of said device in a first chamber having an environment free of contaminants harmful to the processed portion;

locating a second component of said device in a second chamber, separated from said first chamber by a barrier, and having an environment which may contain said harmful contaminants;

protectively covering said processed portion of said first component;

breaking said barrier between said chambers;

and removing said protective cover from said processed portion during assembly of said first and second components without substantially exposing said processed surface of said first component to said second environment.

1 Claim, 9 Drawing Figures

METHOD AND APPARATUS FOR CONSTRUCTING ELECTRONIC DEVICES

This invention relates to electronic devices and, more particularly, to a new and improved method and apparatus for constructing such devices. Specifically, this application concerns an improvement in the process and apparatus disclosed and claimed in a concurrently filed application of Pakswer et al, Ser. No. 518,478, which is assigned to the same assignee as the present invention. The utility of the apparatus and process of the present invention is particularly well exemplified and apparent in the manufacture of image converters, and accordingly the invention will be described in this context, although it will be obvious that the invention is not so limited in application and may be applied successfully to the construction of a variety of electronic devices wherein problems similar to those to be discussed arise.

As is well understood, an image converter is a device which operates to project an electron image from a photoemissive cathode or input component in response to excitation by incident radiation, whether visible or invisible, representing an optic image source. The projected image is directed by means of a suitable electric field to a fluorescent viewing screen where the electron image is converted to a visible reproduction constituting a replica of the original image projected on the photoemissive cathode. A number of these converter stages may be connected in succession, in which case the output of one stage serves as the source image for the succeeding stage, to procure further intensification of the original object image.

An existing method of manufacturing image converters entails making an assembly of all components of the device, including a partially processed screen or input component, and sealing the enclosing envelope preparatory to evacuating. Further processing of the screen required to form an active photoemissive layer is generally accomplished by evaporating an alkali metal activator thereon which chemically reacts with the partially processed screen surface to form the desired photoemissive layer, all while the pick-up screen is assembled and mounted within the tube envelope. Inadvertent deposition of alkali metal vapors on walls of the tube, etc., during such processing often results in spurious electron emission, known as "dark currents", in subsequent operation of the device. Also, the need for adequate removal of materials of low work function, such as alkali metal deposits, from inside parts of the tube to achieve freedom from added spurious noise is generally inconsistent with optimum processing conditions for the photo-cathode.

In the case of multi-stage converter tubes having a plurality of such pick-up screens within the same vessel, there is often a detrimental interaction between the screen being processed and remaining screens. This interaction is especially pronounced when the several screens are to be of different types and require different processes for their formation. Yet another difficulty attendant the manufacture of multi-stage image converters by the above described process is that the yield for a tube of X stages, considering only the likelihood of failure of an individual input component, is $2^{-X}$ that expected for a single stage device. As is obvious, the yield for a multi-stage device drops drastically with an increase in the number of stages. Further, even if the input component of each stage is operative, an optimumly performing tube does not necessarily result, as optimum performance usually requires selective association or matching of those pick-up components having response characteristics falling within a predetermined tolerance or acceptability range.

The above deficiencies of the prior art are substantially avoided by employment of the process and apparatus of the aforementioned Pakswer et al application; the present invention is concerned with a valuable and novel refinement in the Pakswer et al process.

Accordingly, it is an object of this invention to provide a new and improved method and apparatus for constructing electronic devices.

It is also an object of the present invention to provide an improved method and apparatus for manufacturing an electronic device in which certain components of the device require processing in a highly specialized environment, and a presence in such a specialized environment after construction and even during operation.

It is another object of this invention to provide an improved method and apparatus for manufacturing electron tubes of the type comprising, within a common envelope, two or more components which require mutually incompatible processing operations.

It is yet another object of the invention to provide an improved method of manufacturing electron tubes including a photoemissive element and an additional element which must be protected from exposure to materials employed to activate the photoemissive element.

It is still another object of the present invention to provide an improved method and apparatus for manufacturing multi-stage image converters and the like in which a plurality of photoemissive elements are contained in a common evacuated envelope, which provides greatly improved yield and performance characteristics in mass production of such devices than heretofore obtainable.

In accordance with the invention, the method of constructing an electronic device comprises the steps of processing at least a portion of a first component for the device in a first chamber having an environment free of contaminants harmful to the processed portion, and locating a second component of the device in a second chamber, separated from the first chamber by a barrier, and having an environment which may contain the harmful contaminants. After the desired processing of the first component has been completed, the processed portion thereof is protectively covered and the barrier between the chambers is broken. The protective cover is removed during assembly of the first and second components but without substantially exposing the processed surface of the first component to the second environment.

The features of the present invention which are believed to be novel are set forth with particularity in the appended claims. The invention, together with further objects and advantages thereof, may best be understood by reference to the following description taken in connection with the accompanying drawings, in the several figures of which like reference numerals identify like elements, and in which:

FIG. 1 is a perspective view, partly in section, of a first enclosure containing apparatus useful in the inventive process;

FIGS. 2 and 3 are cross-sectional views taken along lines 2—2 and 3—3, respectively of FIG. 1;

Figure 1:
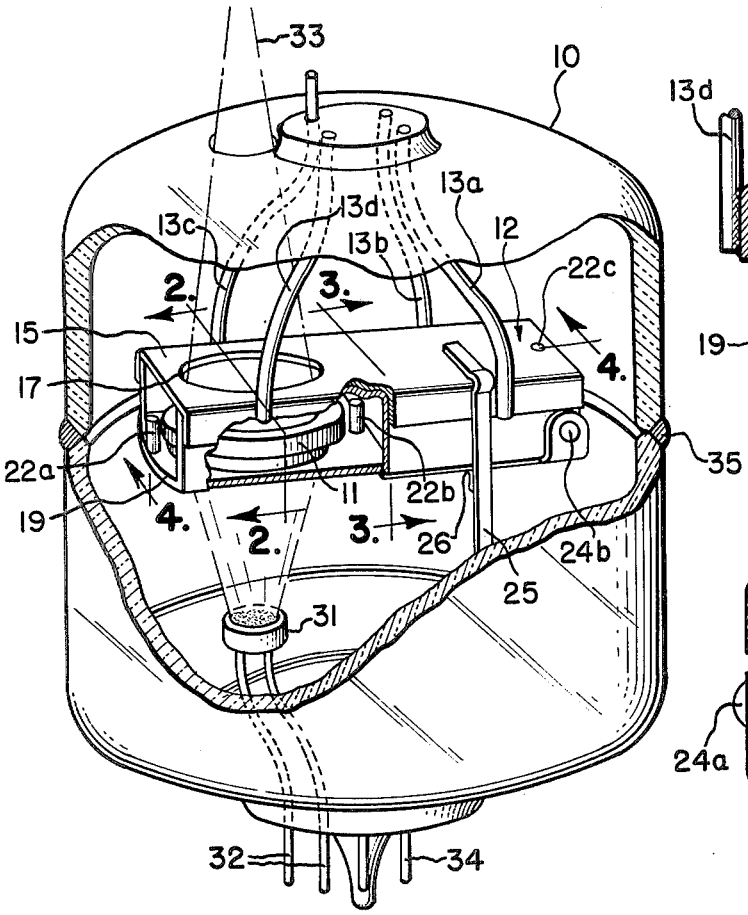
Figure 3:
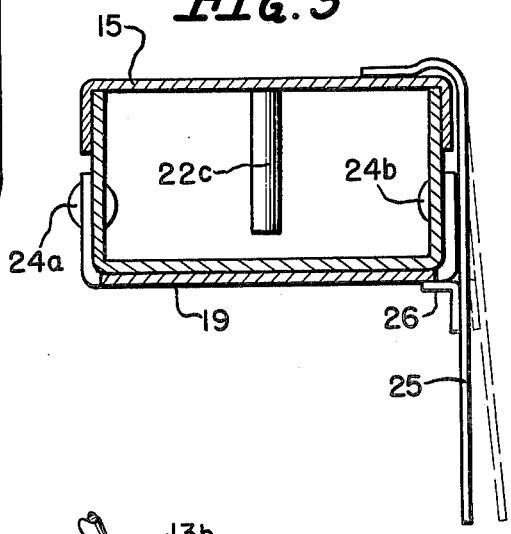
Figure 4:
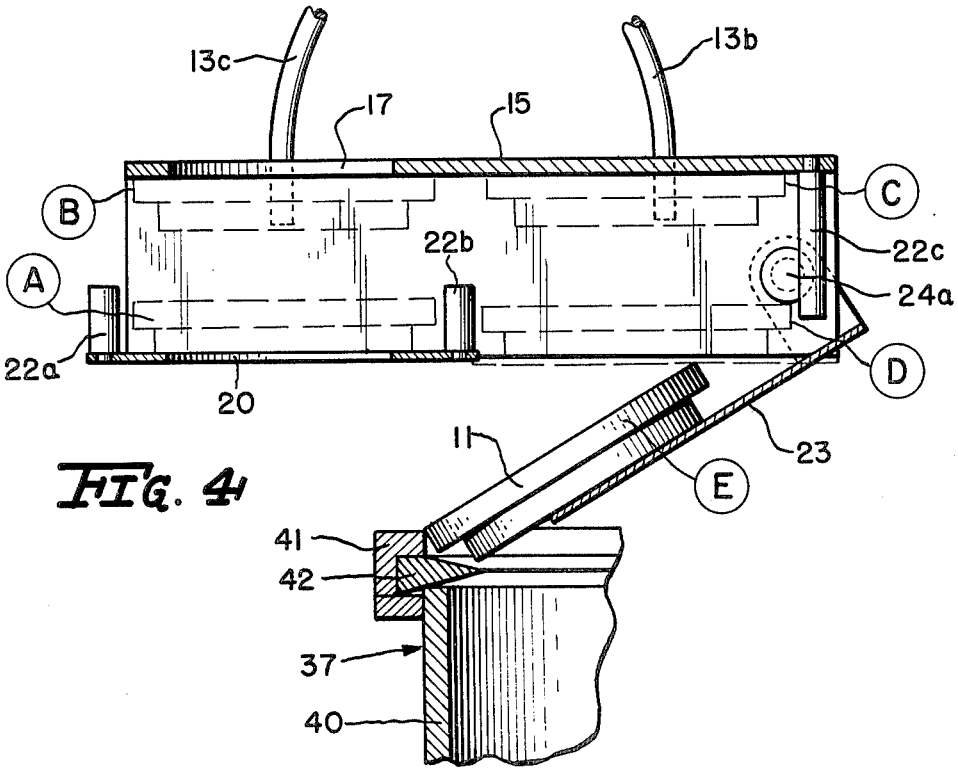
FIG. 4 is a cross-sectional view taken along line 4—4 of FIG. 1, and in addition illustrates a step in the process of the invention.

Referring now to FIG. 1, there is shown a first chamber 10, which may consist of a cylindrical glass enclosure having established therein by vacuum pumping means or the like a first predetermined environment and containing a first component 11 of the electronic device to be manufactured. Component 11, herein a photocathode, is supported by a box-like structure 12 suspended from four spaced wire rods 13*a*, 13*b*, 13*c* and 13*d*, each having one end embedded in a transverse top surface of enclosure 10 and an opposite end affixed to box 12; rod 13*c* also serves as an electrical lead and extends above the top of enclosure 10 for this purpose. The structure 12 for supporting cathode 11, as best shown in FIGS. 1–4, comprises a U-shaped channel member 15 apertured at 17 and a mating U-shaped channel member 19 having a corresponding aperture 20 located immediately beneath the initial position of the cathode. Cathode 11, as shown in FIG. 4, assumes a plurality of positions A-E in relation to box 12 during processing thereof; improper positioning of element 11 within the box is prevented by the side walls of the channel and by a series of posts 22*a*, 22*b* and 22*c* affixed to one or the other of the channel members. In position D, cathode 11 overlies a trap door 23 formed in the lower surface of member 19 and pivotally affixed to the sides thereof by rivets 24*a*, 24*b*. Door 23 is shown in its open position in FIG. 4, but is normally maintained in a closed position indicated by the dashed outline in FIG. 4 by a locking member 25. Member 25 as seen in FIG. 3 consists of a flexible strap having one end affixed to the top surface of channel 15 and a depending side portion normally biasing an L-shaped tab 26 thereon into the path of door 23; strap 25 is yieldably movable to the position indicated by the dashed outline in FIG. 3 to allow the door to assume its open position.

Figure 2:
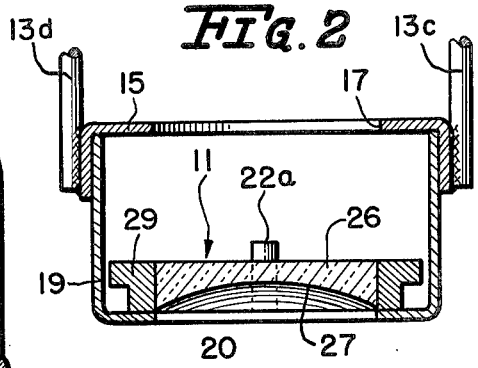

As shown in FIG. 2, photo-cathode 11 comprises a central portion or substrate 26 having a spherically contoured undersurface 27 which is to be provided with an active electron emissive layer responsive to incident radiation of a given wavelength for emitting an electron image. Substrate 26 may consist of a transparent material such as glass or, alternatively, may be of a fiber optic type construction, but in a multi-stage tube in which there are plurality of cathodes 11 and wherein, unlike here , the photo-cathode structure does not form an exterior support wall for the tube envelope, the substrate 26 is usually a transparently thin barrier layer of aluminum oxide serving to separate the prepared emissive surface layer 27 and a light emitting phosphor-resin layer, the phosphor layer providing the optic source image for a succeeding stage. Portion 26 in the present embodiment is rimmed by an annular shoulder or peripheral portion 29 of L-shaped cross-section which is useful for mounting the member to a second component or envelope structure to be considered hereafter. The composition and structure of various tyes of screen structures suitable for use in image conversion devices may be had by reference to U.S. Pat. No. 2,955,218, 2,955,219, 3,011,919, and 3,163,765.

Surface 27 of component 11 is processed by means including a vapor source 31 located within enclosure 10 but having control leads 32 projecting without the enclosure and connected to an appropriate energizing and control source of conventional design (not shown). Means also may be provided for testing the processed input component to determine the response characteristics thereof, as by exposing it to radiation of an appropriate wavelength from a source beamed through aperture 17 in the top surface of box 12. As indicated by the dashed rays 33 in FIG. 1 this source may be, if desired, located externally of enclosure 10 as likewise may be the means for registering the sensitivity and other necessary response characteristics of component 11. In the illustrated embodiment, it is contemplated that a high voltage potential be applied between lead 13*c*, which is conductively coupled to cathode surface 27 through metal box 12 and flange 29 of the cathode, and an anode (not shown) coupled to lead 34. A microammeter, likewise not shown, is coupled in series with the voltage source and meters the current collected by the anode in response to radiation 33. It is understood that the portion of the apparatus just described, but not illustrated may be of any well-known, conventional design.

Enclosure 10 is prestressed by a notch encircling the mid-section thereof and this notch is provided with a braided tungsten cutting wire 35 for causing a break to develop along the notch when the wire is electrically energized.

Figure 5:
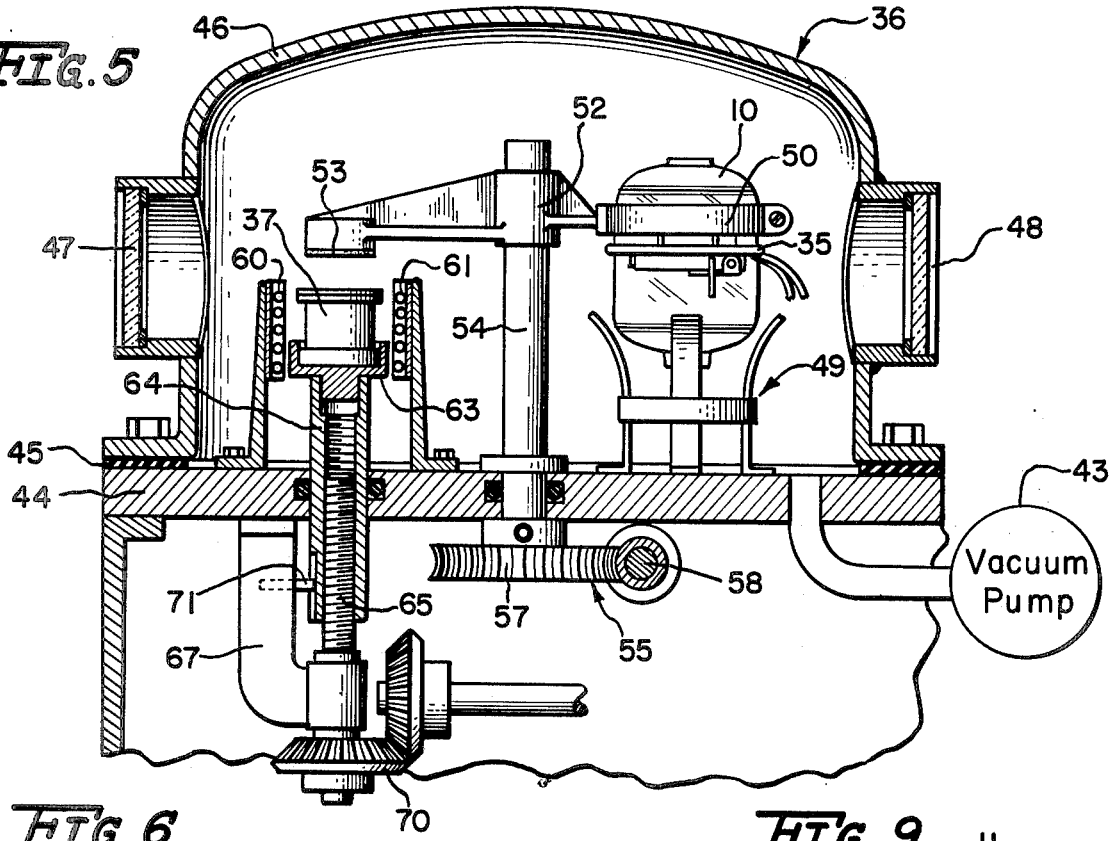
FIG. 5 is a fragmentary cross-sectional view showing a second chamber and further apparatus useful in practicing the present invention.

In FIG. 5, there is shown a second enclosure or chamber 36 containing a second component 37 of the image converter to be manufactured. Component 37 comprises, as seen from the illustrations in FIGS. 4 and 9, an annular base 38 having an optically clear central portion 39 with a phosphor viewing screen formed on the spherically curved interior surface thereof and a cylindrical connecting sector 40 having conductive interior walls forming focus means. Sector 40 also carries at its open end an annular shoulder 41 of U-shaped cross-section provided with an indium sealing flange 42 upon which the flange of component 11 rests when the latter is seated in the open end of component 37 to constitute therewith a closed intensifier system. As seen from the foregoing, each component of the image converter is formed of simple, basic parts which as will be shown are easily assembled. The simple components are considered highly desirable for practicing the invention as such facilitate processing and assembly which of necessity must be done by remotely controlled apparatus; however, the component structures shown herein are by no means indispensable to the invention and should in no way be construed as a limitation upon the method of the invention.

Chamber 36 is provided with a predetermined environment, established by a vacuum pumping source indicated schematically at 43, which environment may or may not be different from that of enclosure 10, but at any rate the chambers are separated by a barrier. In the preferred embodiment shown in FIG. 5, enclosure 10 is located entirely within chamber 36, the walls of enclosure 10 forming the barrier between the environments of the two chambers. It is understood, of course, that chambers 10, 36 may take a variety of physical forms; for example, they may be adjacent chambers of a single enclosure separated by a membrane barrier which is removable or breakable at the approriate time in the process. Herein, however, chamber 36 comprises a base 44 to which is bolted via a sealing gasket 45 a removable top bell 46. Bell 46 is provided with a pair of spaced viewing portals 47, 48 while the interior of chamber 36 is provided with various apparatus for practicing the invention.

Specifically with regard to this apparatus, enclosure 10 is supported within chamber 36 and immediately above a basketlike structure 49 by an adjustable 0-clamp 50 which is integral with one arm of a transfer member; the oppositely extending arm of member 52 carries at its terminus a pressure plate 53 which is used in a final step of the assembly of the electronic device. Member 52 also has a central bore by means of which it is journalled on an upright post 54 which extends through base 44 of the chamber and connects to a gear mechanism 55 comprising a gear 57 affixed to and coaxial with shaft 54 and rotatable by a worm gear 58. Worm 58 is in turn coupled to appropriate electrical or mechanical drive means (not shown). Means for processing the second component 37 of the device is also included within chamber 36 and comprises parallel spaced opposed heating members 60, 61 which are bolted to base 44 of chamber 36 and coupled by wires to a suitable energizing source located externally of the chamber. Component 37 is placed in a cup-like member 63 located intermediate the heating elements and seated in a mated sleeve 64. Sleeve 64 is internally threaded to accept a screw 65 which is journalled in a support arm 67 depending from base 44. Screw 65 is rotatable to lower or raise sleeve 64 by external drive means (not shown) connected thereto via a beveled gear mechanism 70. A locking pin 71 projecting through a slot in sleeve 64 normally prevents movement or slippage of the sleeve with respect to screw 65. Although only indicated schematically in the drawing of FIG. 5, it is understood that each of the apertures in base 44 of chamber 36 is vacuum tight and may be comprised of some form of bellows arrangement to attain this objective.

To understand the method of the present invention, it is necessary to again return to FIG. 1. Photo-cathode 11 is installed within chamber 10, and more specifically, is placed in the position indicated overlying aperture 20 in channel member 19. The cathode may first, however, be treated to the extent possible or necessary at room condition. For example, an unactivated cathode material may be deposited on surface 27 of element 11 and a phosphor layer formed on the opposite surface thereof. A predetermined environment is then established within vessel 10, herein preferably a vacuum of 10−6 torr., and the enclosure is gettered or pre-baked to eliminate possible remaining environmental contaminants. Coated surface 27 of photo-cathode 11 is further prepared from activating source 31 by evaporating antimony thereon, as indicated schematically by the dashed rays emanating from source 31; surface 27 is further coated, for example, with a tri-alkaline composition comprising cesium, potassium and sodium which are generated from individual sources, not shown, but also located within vessel 10. The construction and operation of these sources is well understood in the art and the earlier mentioned patents may also serve as a reference in this regard. The described type of photo-cathode is responsive to visible light; however, other well-known photo-cathode types which are sensitive to infrared radiation, X-rays or the like may also be successfully constructed by the present process. Once the cathode has been processed to completion, its response characteristics may be tested by illuminating the surface thereof in the manner indicated schematically by rays 33. These rays consist of radiation of a predetermined wavelength projected through top aperture 17 in box 12 and the response of the cathode thereto is determined by applying a high voltage between cathode surface 27 and an anode (not shown) coupled to lead 34. As previously explained, an ammeter is coupled in series with the high voltage source between leads 13c and 34 and the current indication provided by the ammeter in response to the radiation striking cathode surface 27 informs the technician of the cathode condition and response characteristics.

Thus at this stage of the process it is known whether or not component 11 is acceptably operable, and if so, the precise characteristic thereof within the range of acceptability. Hence, those enclosures containing inoperative cathode devices may be discarded and the enclosures containing acceptable cathode devices may be selectively grouped for installation into multi-stage devices. Thus it is assured that the completed device will not have to be discarded because of inoperative input components, the most likely source of failure, and that multi-stage tubes will have an optimum association of input component characteristics.

To this point, the description of the practicing of the method is similar to that of the aforesaid Pakswer et al application; however, in accordance with the improvement of the present invention, input component 11 is supported within enclosure 10 by box 12 and is moved from its processing position within the box, indicated at A in FIG . 4, to position D upon completion of the necessary processing and testing. This is accomplished by inverting enclosure 10 to drop the component to position B, then tilting the enclosure to move component 11 horizontally to position C, and finally righting chamber 10 to locate the component in position D. As previously mentioned, direct lateral movement of component 11 between positions A and D is prohibited by post **22*b***.

With input component 11 in position D, enclosure 10 is ready for location in chamber 36, supported by 0-clamp 50 as indicated in FIG. 5. In the case of multi-stage image converters, a plurality of enclosures 10 having input components with response characteristics matched for optimum tube performance are placed in holders similar to clamp 50 which may be spaced angularly about post 54. Likewise, a plurality of second components 37 are located within chamber 36 and apparatus may be provided for successively placing the components into position for processing and assembly. Specifically, as each image conversion stage is assembled, it may be stacked on a previously assembled stage and the peripheral shoulder portions joined by heliarc or electron beam welding, techniques familiar to the art. In multi-stage tubes it may also be convenient to have the output component of one stage formed as a single unit with the input component of the succeeding stage, one separated from the other only by a predetermined thin barrier layer as discussed earlier herein. For convenience, however, apparatus for constructing only a single stage image converter is illustrated in the drawing.

Next bell 46 is placed on base 44 and is bolted thereto after which vacuum pump 43 evacuates the chamber to a predetermined low pressure preferably $10^{-4}$ torr. or less. Once this environment is established, subassembly 37 is processed by heaters 60, 61 to remove impurities from the interior surfaces of the component and to expel any contaminants harmful to photo-cathode 11 that may be possibly present within the environment of chamber 36. Preferably, subassembly 37 is baked at a temperature of 300° C. for a period of one hour, and then reduced to a temperature of 120° C. during placement of input component 11 therein. The relatively cold chamber 36 acts as a getter for component 37, and thus a new environment free from contaminants possibly existing in the intermediate or transfer environment of chamber 36 is produced within the interior of subassembly 37. Component 42 alternatively may be purified by other methods such as preferential pumping or electron bombardment. Where exceptionally clean conditions are necessary, a protective covering may be placed over the open end of component 37 after processing thereof and removed only an instant before input component 11 is to be installed therein.

Figure 6:
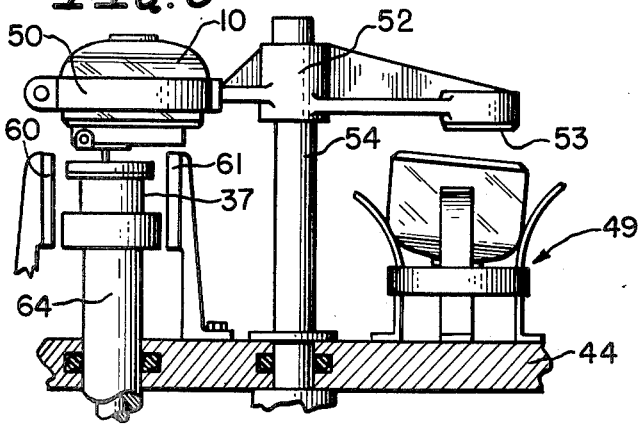
FIGS. 6, 7 and 8 are side elevational views, partly in cross-section of a portion of the apparatus of FIG. 5, illustrating successive process steps in practicing the present invention with this apparatus.
Figure 7:
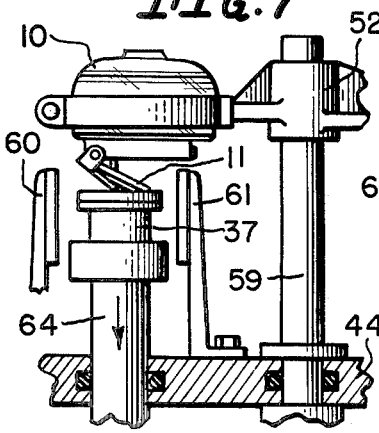
Figure 8:
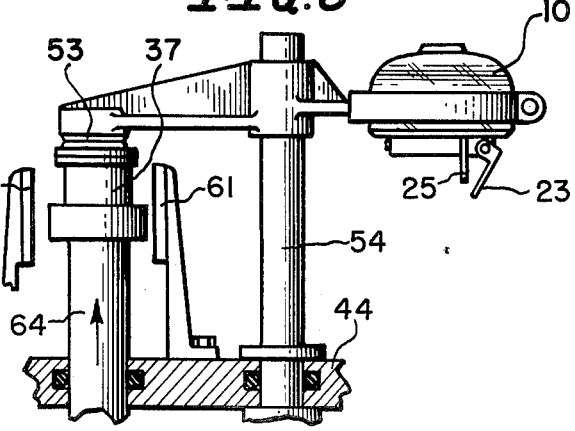

The remaining steps in carrying out the process of the present invention can now be understood by reference to FIGS. 6–8. Enclosure 10 is opened to admit input component 11 into the transfer environment of chamber 36 by initiating an electrical current through cutting wire 35 which serves to crack enclosure 10 about its circumferential notch, the lower half of the enclosure falling into basket 49. In FIG. 6, the operator also has rotated bracket arm 50 via gear mechanism 55 in a counterclockwise direction moving the box-like structure 12 carrying component 11 into proximity with subassembly 37; the vertical position of component 37 is previously adjusted such that the end of flexible strap 25 depending below box 12 will engage component 37 upon continued rotation of shaft 54. In FIG. 7, the holding tab of strap 25 has been urged away from trap door 23 allowing this door to open and slide component 11 into engagement with the mated opening of component 37 as depicted in detail in the exploded view of FIG. 4. Shaft 54 is then rotated clockwise back along the path originally traversed thereby sliding trap door 23 from beneath component 11 and allowing this component to fall into place in the opening therefor in subassembly 37. As clearly shown in FIG. 4, trap door 23 is so designed and located relative to subassembly 37 as to assure the processed surface of component 11 is protectively covered except for the briefest interval during which the component is dropped into place within the opening of the subassembly. Thus, harmful contaminants which may be present within the environment of chamber 36 are given little, if any, opportunity for access to the processed surface of component 11.

Figure 9:
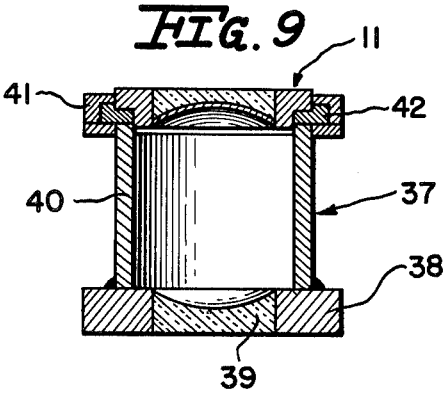
FIG. 9 is a cross-sectional view of an electronic device constructed in accordance with the present invention.

Rotation of shaft 54 is continued until pressure plate 53 of transfer member 52 is relocated in its original position above assembly 37. Screw 65 is then operated to raise sleeve 64 and bring the exterior surface of component 11 into firm engagement with pressure plate 53, forcing the component against the indium sealing ring encompassing the periphery of component 37. Indium ring 42 is quite soft and is readily malleable to form a firm vacuum seal between members 11, 37. The completed electronic device is shown in FIG. 9.

Empirical study has clearly revealed that without the use of the protective plate formed by trap door 23 to cover the processed surface of component 11, it is necessary to assemble components 11 and 37 in a very short period of time or else the response characteristics of photo-cathode 11 may be substantially deteriorated by harmful contaminants present in the environment of chamber 36. For reasons not presently fully understood, numerous experiments have shown that total or partial destruction of the photo-cathode is inevitable upon prolonged exposure to the transfer environment of chamber 36. Contamination of the photo-cathode was found to occur when enclosures 10 and 36 were evacuated to the same pressures, when the chambers were evacuated to different relative pressures, and even when inert gases such as helium were used in enclosure 36. For example, in one experiment when chamber 36 was evacuated to the extremely low pressure of $10^{-8}$ torr. by means of cryogenic cooling, photo-cathode sensitivity decayed to a 50% value within 5 minutes after exposure to the environment of the large chamber.

The simple technique described of the imposition of a protective cover or plate over the processed surface of component 11 prior to admission of this component into chamber 36 requires only a vacuum of $10^{-4}$ torr. in chamber 36 and still allows the photo-cathode characteristics to remain unchanged for periods upward of several hours. The processed surface is fully protected by mere gravity contact with a cover such as trap door 23. Also, it is not essential nor necessarily desirable that the entire processed surface of component 11 be in contact with the protective cover plate and all that is necessary is that at least a peripheral portion such as shoulder 29 of the first component maintain contact with the plate. Further, it should be understood that the concept of protectively covering the processed surface is not limited to a mechanical covering as illustrated but should be construed to embrace chemical as well as other types of coverings. It is desirable however that the cover be removed from the processed portion during assembly of the first and second components without substantially exposing the processed surface of the first component to the second environment, and, for example, in the case of chemical coverings, it may be feasible to remove the cover layer by baking the assembled unit after installation of component 11 in subassembly 37, thereby totally avoiding exposure of the processed surface to the transfer environment.

The reason that gravity contact between component 11 and protector plate 23 is adequate to preclude contaminants from reaching the processed surface although the gaps between the plate and component may be enormous relative to the size of a molecule, appears explicable by reference to two characteristically different types of molecular flow. At pressures of $10^{-4}$ torr, or less, to which it is desired that enclosure 36 be evacuated, it is believed that the remaining molecules within the enclosure exhibit only Brownian movement and that laminar gas flow due to pressure differentials is eliminated. In the case of Brownian movement, the mean free path of an individual molecule is very large, being many times greater than any gap existing between the component and the cover plate. Hence, it is necessary that a molecule strike the protector plate at a critical point and angle in order to be deflected into a gap between the component and the plate and thus reach the processed surface. The probability of such angular incidence or movement of a particle horizontally directly into a gap is highly unlikely. However, in laminar flow, a state in which the molecules of a gas can be considered to flow in a manner analogous to that of water, the mean free path of each molecule is extremely short and it is quite easy for the gas to "seep" through the gaps between the plate and the component and contaminate the processed surface. Under such conditions, it would indeed be necessary to form a vacuum seal between the component and the protective plate to avoid contamination of the processed surface of component 11.

Thus, the novel process and apparatus taught by the present invention provide an improved method of constructing an electronic device. This method is especially attractive in the manufacture of electron tubes which comprise, within a common envelope, two or more components requiring mutually incompatible processing operations. The invention also permits, as specifically shown in conjunction with the manufacture of a multi-stage image conversion device, greatly improved yield and and performance characteristics in mass production of such devices than heretofore obtainable.

While a particular embodiment of the invention has been shown and described, it will be obvious to those skilled in the art that changes and modifications may be made without departing from the invention in its broader aspects, and, therefore, the aim in appended claims is to cover all such changes and modifications as fall within the true spirit and scope of the invention.

I claim:

1. A method of contructing an electronic device comprising the following steps:

processing at least a portion of a first component of said device in a first chamber having an environment free of contaminants harmful to the processed portion;

locating a second component of said device in a second chamber, separated from said first chamber by a barrier, and having an environment which may contain said harmful contaminants;

protectively covering said processed portion of said first component;

breaking said barrier between said chambers;

and removing said protective cover from said processed portion during assembly of said first and second components without substantially exposing said processed surface of said first component to said second environment.

2. A method of constructing an electronic device comprising the following steps:

processing a surface portion of a first component of said device in an enclosure having an environment free of contaminants harmful to the processed portion, said surface portion of said device being outlined by a predetermined peripheral portion;

placing said enclosure in a chamber containing a second component of said electronic device and having an environment which may contain said harmful contaminants;

placing at least said peripheral portion of said first component in contact with a cover for said processed surface;

opening said enclosure to admit said protectively covered first component into the environment of said second enclosure;

and removing said cover from said processed portion during assembly of said first and second components without substantially exposing said processed surface portion of said first component to said second environment.

3. In the process of manufacturing an image conversion device comprising a photocathode element for insertion into a subassembly including an output screen and electron focusing means by the technique of placing said photocathode in a first enclosure having a first predetermined environment, placing said subassembly in a second enclosure having a second predetermined environment, adjacent said first enclosure and separated therefrom by a barrier, processing said photocathode in said first enclosure, removing said barrier between said enclosures and assembling said photocathode and said subassembly to form a completed image conversion device, the improvement comprising:

the imposition of a protective cover over the processed surface of said photocathode prior to removal of said barrier between said enclosures;

and removing said protective cover during assembly of said photocathode and said subassembly without substantially exposing said processed surface to said second environment.

4. A method of constructing an electronic device comprising the following steps:

processing a surface portion of a first component of said device in a first chamber having an environment free of contaminants harmful to the processed portion, said surface portion of said device being outlined by a predetermined peripheral portion;

locating a second component of said device having an opening for receiving said first component to form a closed system therewith in a second chamber having an environment which may contain said harmful contaminants;

placing at least said peripheral portion of said processed surface of said first component in gravity contact with a coplanar portion of a protective cover plate;

placing said envelope containing said processed first component in a chamber containing a second component of said electronic device and having an environment which may include said harmful contaminants;

processing said second component to establish in the interior thereof an environment receptive to said processed first component;

opening said enclosure to admit said first component into said second chamber;

and separating said first component from said plate and placing said first component in said opening of said processed second component to form said closed system without substantially exposing said processed surface of said first component to said contaminants of said intermediate environment.

5. Apparatus for manufacturing an image conversion device by the technique of processing a photocathode therefor in a first predetermined environment and exposing said photocathode to a second predetermined environment for assembly with the remaining portion of said image conversion device which remaining portion comprises an envelope having a viewing screen affixed to one end thereof and an opposite end for receiving said photocathode to form therewith a closed system, said apparatus comprising:

a first chamber having established therein said first environment and containing said photocathode;

means within said first environment for processing the emissive surface of said photocathode;

a second chamber containing said remaining portion of said image conversion device and having established therein said second environment;

barrier means separating said chambers from one another;

means for breaking that portion of said barrier means separating said first and second environments;

means for protectively covering said emissive surface of said photocathode prior to breaking said barrier means;

and transport and assembly means for bringing said remaining portion and said photocathode together, removing said protective means from said processed surface of said photocathode, and for inserting said photocathode into said remaining end portion of said image conversion device to form said closed system.

* * * * *